United States Patent [19]

Gilbert

[11] Patent Number: 5,005,290

[45] Date of Patent: Apr. 9, 1991

[54] UTILITY KNIVES

[75] Inventor: Richard Gilbert, Dronfield, Great Britain

[73] Assignee: The Stanley Works Limited, Bracknell, England

[21] Appl. No.: 435,377

[22] PCT Filed: Apr. 29, 1988

[86] PCT No.: PCT/GB88/00342

§ 371 Date: Jan. 8, 1990

§ 102(e) Date: Jan. 8, 1990

[87] PCT Pub. No.: WO88/08775

PCT Pub. Date: Nov. 17, 1988

[30] Foreign Application Priority Data

May 8, 1987 [GB] United Kingdom ..... 8710980

[51] Int. Cl.[5] ..... B25F 3/00; B26B 1/00; B26B 5/00; B26B 1/04

[52] U.S. Cl. ..... 30/162; 30/125; 30/320; 30/335

[58] Field of Search ..... 30/125, 162, 320, 335, 30/169, 330

[56] References Cited

U.S. PATENT DOCUMENTS 3,660,895 5/1972 West ..... 30/162
4,005,525 2/1977 Gringer ..... 30/125
4,240,202 12/1980 Gilbert ..... 30/162
4,575,936 3/1986 Gringer ..... 30/330
4,615,118 10/1986 Ihata ..... 30/162

FOREIGN PATENT DOCUMENTS 2181689 4/1987 United Kingdom ..... 30/162

*Primary Examiner*—Douglas D. Watts
*Assistant Examiner*—Paul M. Heyrana, Sr.
*Attorney, Agent, or Firm*—Chilton, Alix & Van Kirk

[57] ABSTRACT

A utility knife comprises a lower elongate part shell 1 and an upper such part shell 3 forwardly fitted with interengaging wedging surfaces whereby they clamp together on relative longitudinal movement. This movement is achieved by turning nut 2 on shank 8 to bear on wall 30. The loosening of the nut 2 to unclamp the part shells and thus permit blade 43 to be pushed forward with slider 42 by pushbutton 41 does not separate the part shells 1 and 3 since the end spur 9 of the shank 8 still rides on arresting web 37. Maximum unscrewing of the nut, however, permits separation e.g. for access to stack of spare blades 60 resiliently held at 59 in the rearward part of shell 1 (now unencumbered by the conventional screw-shank), but does not lead to loss of nut 2 because of a complementary detent configuration 25 at the end of the shank and in the end wall 2*a* of the nut prevents complete nut/shank separation. Spur 9 can be upwardly sloping at its underside and thus constitute an auxiliary clamping means for part shell 1 against part shell 3.

9 Claims, 3 Drawing Sheets

UTILITY KNIVES

This invention relates to utility knives.

Utility knives are cutting tools capable of a wide range of uses basically comprising a handle into which a replaceable knife blade is fitted and immobilised so as to protrude from one end.

In some instances the knife is such that the blades must be completely removed and disposed of when the exposed end becomes blunt, at which time a new blade is fitted. More commonly, the knife has a blade shaped to possess two sharpened ends (e.g. shaped as a symmetrical trapezium with the long edge sharpened) so that when one end becomes blunt the blade can be taken out, reversed, and replaced to expose the other for use. Only when 19 is other end becomes blunt is the blade completely replaced by a new blade. In a preferred form, such blades can also be "retractable" i.e. selectively extendable to any one of a number of immobilisable positions.

In recent years the blade has been embodied as a long metal strip, sharpened along one edge and provided with score lines or like lines of weakness across its width at an acute angle, that is, so as to come to a sharp point at the sharpened edge. As for a slmpleretractable blade this elongated blade is supported within the handle on a carrier, and the resilient part of carrier is biassed against the teeth of a longitudinal rack. A press button extending through a longitudinal slot in the handle enables the user to press the resilient part of the carrier out of engagement with its rack and slide it up or down within the handle. Thus, the blade can be retracted for safety, or can be forwarded to a desired operative position. When desired, since a line of weakness is apparent, beyond the handle, the blade can be broken transversely to expose a new sharp point and sharpened edge portion.

Such utility knives often have handles formed essentially as two longitudinally divided part shells, the exact parting line along the handle being designed in practice for reasons of function or appearance not to be a simple straight longitudinal bisection.

Originally, the part shells were held together by one or more transverse threaded bolts. To change, or reverse, a blade the bolts were unscrewed, one shell was removed, and the blade manipulated as necessary. Typically a "replaceable" blade, whether retractable, and whether for single use or double use is provided with holes or notches to fit by mechanical interengagement within the handle so as to resist longitudinal pressure (otherwise serving to push the blade back when in use) and for replacement the blade has therefore to be removed from and fitted into such engagement with corresponding projections or shoulders. Transverse clamping effect on the blade, also serving to grip the blade against movement, does exist but is usually of secondary importance against such longitudinal movement. It may however be a significant protection against lateral movement of the blade.

More recently, the so-called "wedge-lock" assembly has been used. In this, the part shells, at a forward location of their parting line (and on both side regions) are formed with a wedging interlock so directed that minor longitudinal movement of one part shell relative to the other causes the wedge formations on the parting line to slide one on the other and thereby draw together, or release, the part shells in a transverse direction. This minor longitudinal movement and thus the clamping or releasing of the part shells can be achieved by a single bolt with a knurled head for finger operation, located at the rear of the handle and threaded in one shell while bearing on the other.

Such a "wedge lock" assembly is particularly useful for the knives with retractable blades. This is because, from time to time, the blade must be retracted or must be advanced and then fixed again. The clamping together of the two part shells, even if it does not have a major effect in resisting longitudinal pressures in use, does militate against easy advancement/retraction of the slide over its rack, and it is usually preferred to slacken the shells slightly so as to facilitate advancement or retraction. An end bolt and "wedge lock" configuration, manually operated, is much more convenient for this essentially brief adjustment than the use of a screwdriver to adjust one or more transverse screws.

In practice it has been established that the transverse blade clamping force using the "wedge lock" assembly, which is exerted over a wedging plane, can be a significant component of the longitudinal resistance to movement of the blade in use; this can lead to advantageous modifications e.g. in the shape and strength of the rack and slide.

Use of an end, or longitudinal, threaded bolt, instead of a transverse bolt or bolts also permits improved design of the effective interior of the part shells when assembled. One aspect of this is the ready provision, even with a short handle, of enough internal space to hold a stack of spare blades, of the single or double use type or of the retractable type.

We have now discovered, however, that use of a stationary, rearwardly-projecting, threaded shank with an operating nut threaded thereon, is even more advantageous and permits a number of inter-related design improvements.

In one aspect therefore the invention provides a utility knife of the type with a handle comprising two elongate part shells capable of assembly about generally longitudinal parting lines so configured at a forward location thereof that relative longitudinal movement of the part shells may cause them to approach each other and clamp to form an assembly locating and immobilising a blade protruding from one end thereof; in which one part shell is provided with a rearwardly extending threaded shank, and the shank passes through an aperture in a rear wall of the other part shell to accommodate a turnable nut whereby relative longitudinal movement of the part shells may be achieved by turning the nut upon the shank to bear upon said rear wall.

Such a shank can further disencumber the internal space, can give an arrestable member to protect against undesired separation on blade extension, can give a means of permanently uniting the operating member (i.e. nut) without risk of loss, and can give an auxiliary wedge-face to assist clamping.

Usually the shank is sufficiently long to extend beyond the nut when the part shells are fully assembled with the nut tightened.

If this is ensured, then a knife can be fabricated in which the said aperture is an open slot and in which the said other part shell includes a portion located to arrest the shank transversely on such full assembly. whereby free separation of the part shells cannot be achieved until the nut has allowed the first part shell to advance so that the end of the shank is no longer arrested.

For a convenient embodiment we prefer such a knife in which the said shank terminates in a spur extending rearwardly from part only of the shank cross section; and in which the arrest portion comprises a transverse web located to fit beneath the said spur. For example the web may be formed to project forwardly from the inner periphery of a ring guard extending from the said other portion rearwardly around the shank and nut. Therefore, if the spur is shaped to have an upwardly sloping undersurface it can be positioned to cooperate with an edge of the said transverse web and to constitute a rearwardly located auxiliary clamping configuration for the two part shells.

Another additional and alternative configuration is to provide a knife as defined above in which the shank possesses at least one radial protuberance at its end and the nut is correspondingly formed with at least one complementary radial detent formation in an end face, to prevent further rotation and separation of the nut. Preferably the shank possesses two different radial protuberances successively arranged in the direction of rotation with (a) a lower gently contoured profile over which the detent may resiliently ride in either direction on exertion of a predetermined and warning level of force and (b) a higher, profile step-like to prevent further rotation and separation of the nut but gently contoured to permit initial assembly in the other direction.

For convenience in manufacture it is preferred if the two part shells are integral die cast structures and the thread on the shank is accordingly interrupted at its sides to permit shell removal from the mould.

The invention also extends to use of the space left unencumbered by the rearward (i.e. external) protrusion of the shank. Thus the invention further envisages such knives, as described above, accommodating a stack of spare blades at a rearward location of the said first part shell.

Preferably, the stack is held in place by a resilient leaf of material biassed downwardly from an elongate holding frame located within the handle. By way of example a knife may be embodied in which the elongate holding frame defines a longitudinally directed slot with edge portions downwardly directed to provide a rigid structure, said slot permitting passage of the pushbutton of a blade slider protruding from a longitudinal slot in the said other part shell; and in which the frame is foldable upwards about a line forward of the said rigidified edges to allow access to the stack of blades when the part shells are separated. In such an instance a forwardly located position of the said frame may be downwardly biassed to bear upon the protruding blade.

The invention will be further described with reference to the accompanying drawings, in which.

Figure 4:
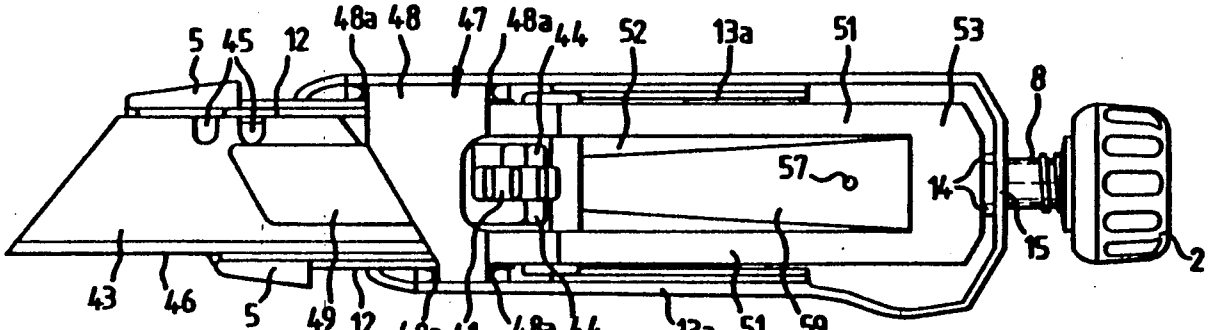
FIG. 4 is a plan view of the lower part of the utility knife shown in FIG. 1 with an assembly nut retracted.
Figure 4A:
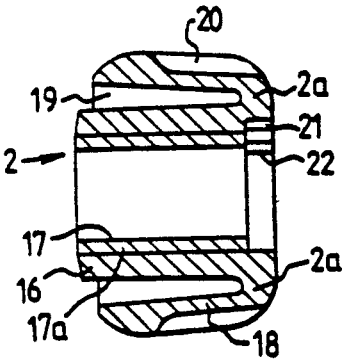
Figure 4B:
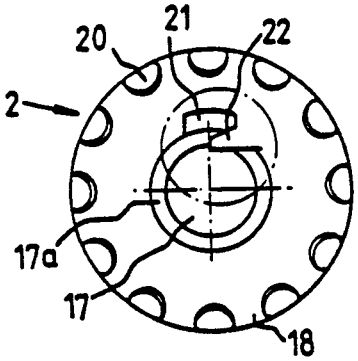
Figure 4C:
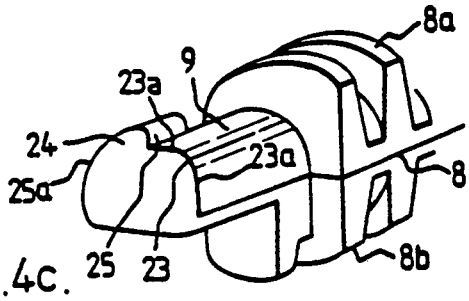
Figure 5:
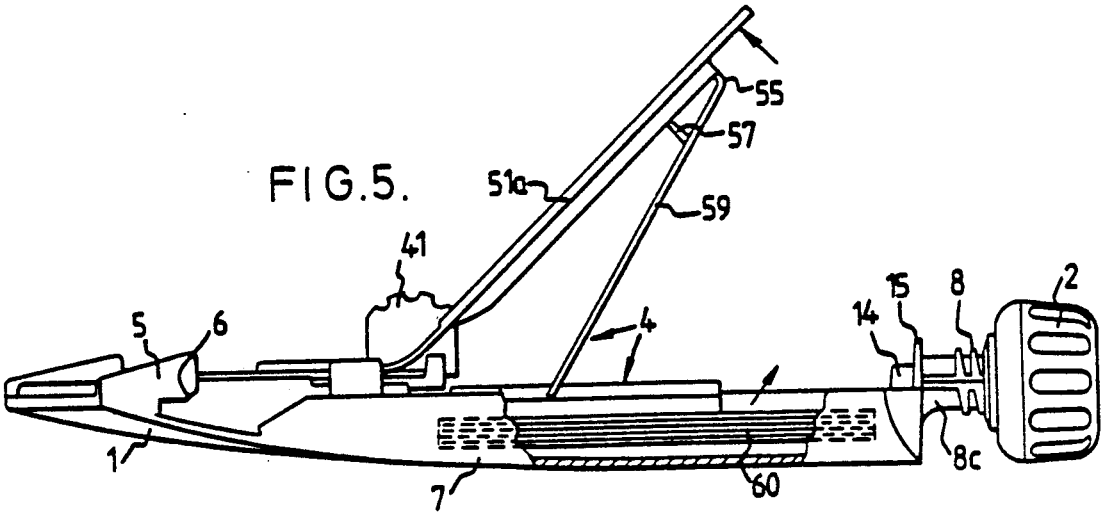
Figure 6:
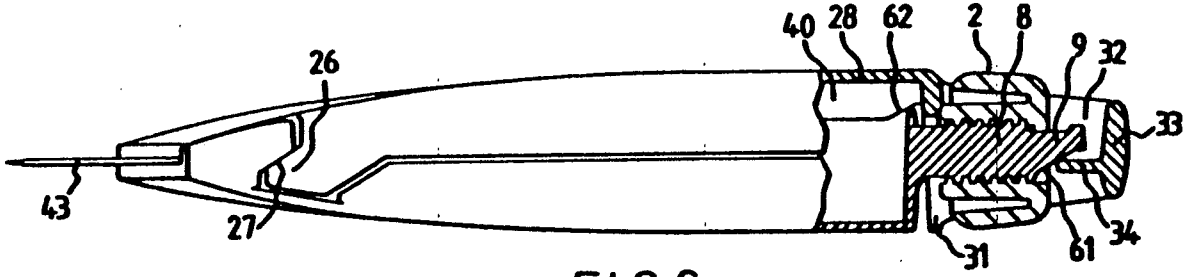
Figure 7:
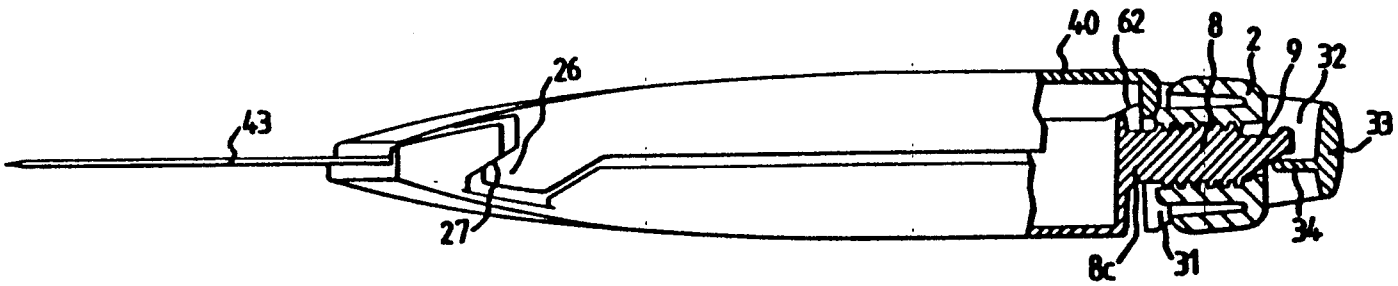

FIGS. 4*a*, 4*b* and 4*c* show details of the assembly nut construction and assembly;

FIG. 5 is a side view of the lower part of the knife as shown in FIG. 4, partly broken away, and with a blade-stack restraint raised;

FIG. 6 is a side view of a variant embodiment of utility knife, partly broken away; and FIG. 7 is a side view as in FIG. 6 with the part shells slightly parted.

The utility knife shown in FIGS. 1 to 5 can be considered in three main parts namely, a lower elongate part shell 1 and associated manually operable assembly nut 2; an upper elongate part shell 3 fitting with the lower shell 1 to define a utility knife handle; and the presentation and storage assembly 4, located within the assembled part shells 1 and 2 with an operative blade end protruding.

The lower elongate part shell 1 can also be seen advantageously in an external view in FIG. 5, and in assembly (of a slightly varied embodiment) in the external views of FIG. 6 and 7. It is a die-cast alloy structure which externally possesses two forward "wedging" structures 5 (see also FIG. 4) with inclined Wedge surface 6; a smooth base wall 7; and a rearwardly projecting shank 8 threaded on its upper and lower surfaces and terminating in integral spur 9 extending rearwardly from its upper portion. Internally it is shaped to support various features of the internal assembly. Thus, forwardly, it possesses two longitudinal support ribs with coplanar upper edges 11, and two longitudinal parallel guide walls 12. In an intermediate location it possesses two further parallel guide ribs 13*a*, over a thickened wall section 13*b*. Rearwardly it possesses two parallel support pillars 14 extending from the rear wall 15 of the part shell.

Figure 1:
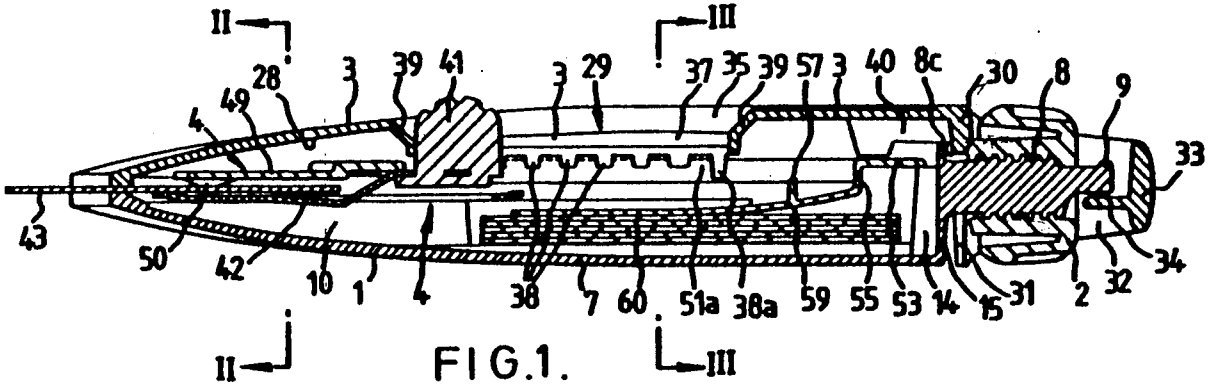
FIG. 1 is a median longitudinal section through an embodiment of utility knife illustrating features of the present invention.
Figure 2:
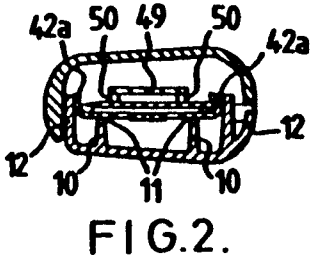
FIG. 2 is a section along line II—II of FIG. 1.

The nut 2 and preferred features of its assembly are shown in FIGS. 4*a*, 4*b* and 4*c*. It comprises an integral molded polymer unit with an internal cylinder 16 possessing bore 17 with internal threads 17*a* and an external contoured frustoconical cover 18 spaced from the internal cylinder 16 by longitudinal ribs 19 and possessing gripping flutes 20 on its outer face. In the end surface thickness 2*a* of the nut the threaded bore 17 is modified in shape by means of a recess 21 and a detent 22 adjacent thereto. This nut is assembled on shank 8 with threads 8*a*, 8*b* on upper and lower surfaces only (to achieve mold release of the die-cast article) and may be located inwards of spur 9 as shown in FIG. 1 or outwards to cover spur 9 as shown in FIGS. 4 and 5.

At the end of spur 9 there is a first integral radial protuberance 23 of lesser radial height and gradual contours 23*a* and a second such protuberance 24 with greater radial height, possessing a step contour 25 and a gradual outer slope 25*a*. These protuberances should be contoured and dimensioned to cooperate with recess 21 and detent 22 as explained more fully below.

The upper elongate part shell 3 may again be generally seen from the embodiment of FIGS. 6 and 7. It is again an integral die-cast alloy structure. Externally it possesses two forward wedge structures 26 with wedge surfaces 27, a smooth upper outer wall 28 with an elongate slot 29 extending centrally therethrough over a central part of its length, and a downwardly extending rear wall 30. Wall 30 is vertically slotted at 31, the slot being open from below to accommodate loosely an internal unthreaded portion 8*c* of shank 8. The integral structure of the upper part shell 3 is continued in a protective integral ring wall 32 extending behind the nut 2 and the shank 8 and spur 9. The rear, transverse, portion 33 of this ring wall has a integral ledge or web 34 extending into the ring space beneath spur 9.

Figure 3:
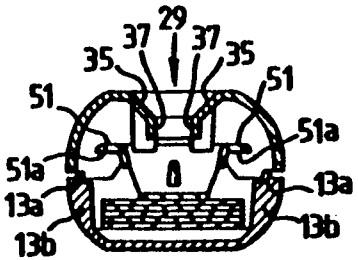
FIG. 3 is a section along line III—III of FIG. 1.

The longitudinal slot 29 of shell 3, as also shown in FIG. 3, has mutually inclined upper walls 35 and parallel lower walls 37 configured as teeth 38 to constitute a rack. The end tooth 38*a* is longer, as a stop member. The slot 29 also possesses inclined end walls 39.

The shell 3 includes a single integral longitudinally extending projection 40 at a rearward position.

The internal assembly 4 comprises an upwardly biassed pushbutton 41 and metal slider 42, and a trapezoidal blade 43 carried on the slider as known in the art. The slider 42 is a shallow metal tray and rides upon the coplanar top edges 11 on walls 10 with its walls 42*a* located between the internal shell walls 12. It is spring biassed so that it normally forces the polymer push button 41 upwardly whereby transverse projections 44 enter between the teeth 38 and are held thereby against longitudinal movement. Blade 43 is immobilised on the slider 42 by suitable lugs or projections in blade recesses 45 opposite cutting edge 46.

Above the level of the slider 42 and blade 43 is located an integral leaf of resilient polymeric material 47. This possesses a forward platform region 48 (pressed into place between stops 48*a* in the lower part shell 1) and a forwardly projecting resilient central tongue 49 possessing shallow ribs 50 on its underside to press against the blade/slider assembly to assist in stabilising it as described below. Rearwardly the leaf 47 has two side portions 51 defining a broad slot 52 in which the pushbutton 41 can move without hindrance. The side portions 51 have downwardly projecting inner walls 51*a* defining the edges of the slot 52 and resistant to flexure over a transverse flexing axis. At the rearward end a second platform 53 is supported at its rearmost edge 54 on the tops of support pillars 14, being held down upon these by the underside of integral upper part shell projection 40.

Platform 53 defines by downward stepped wall 55 a resilient leaf 59 extending along beneath the slot 52 and tapering slightly in width. At its upper surface the leaf presents a projection 57. This resilient leaf holds down a stack of spare blades 60 as shown in FIG. 1 during use of the knife.

FIGS. 6 and 7 show an embodiment of the invention which differs in detail. Thus, for example, no stack of spare blades is shown and the internal structure is unspecified. Many features, however, are identical, for example the upper part shell 3 and especially its rearward portions 32, 33 and 34, the shape of the nut 2, and the general nature of the shank 8 and the spur 9. However, spur 9 differs in detail: instead of extending only from the upper half of the shank 8 it is formed with a slanting lower surface 61 which therefore meets and slides up the ledge 34 as the nut is tightened. Moreover, projection 40 inside upper part shell 3 is cut away at 62, as shown, to accommodate such movement.

Initial assembly of the knife for use, extension or retraction of the blade, and blade replacement, will now be described with reference to the above illustrated embodiments.

Initial factory assembly starts from lower part shell 1, nut 2, upper part shell 3, stack of blades 60, slider/pushbutton unit 42/41, the blade 43 and the polymer leaf 47.

Firstly, nut 2 is forced to turn so that the detent 22(*a*) rides up gently sloping surface 25*a* and thus over the stepped contour 25 and (b) thereafter rides just past the lesser protuberance 23 with its symmetrical gentle slopes 23*a*. At this stage nut 2 will be in the relationship to shank 8 as shown in FIG. 4. Blades 60, slider/pushbutton 42/41, and operating blade 43 are then laid in their designated areas, polymer leaf 47 is placed oVer these units. (as a permanent assembled feature thereafter) and the upper shell is fitted over the whole assemblage so that the slot 29 passes down over shank portion 8*c*, so that the tapering wedge faces 6 and 27 are located opposite one another, and so that the pushbutton 41 extends through the slot in the handle. The nut 2 is tightened, and the two part shells are forced towards one another by the action of the wedging surfaces 6 and 27 until the knife is fully and tightly assembled with the blade held by the slider and by the two part shells at their forward edges.

For blade advancement and retraction, nut 2 is slackened slightly s that the forward edges of the part shells 1, 3 do not grip the blade: slider 42 is operated to a new rack position by pushbutton 41: and nut 2 is tightened up again. Retraction is of course similar.

For blade replacement from the stack 60, the nut 2 is turned backwards until a transient warning difficulty is encountered by virtue of the detent 22 riding up and down surfaces 23*a*, this indicating that the 'stop' position then encountered is intentional and that force should not be used to overcome consequent further resistance. The upper half shell 3 is raised. The leaf 47, being elastic, lifts slightly and can be bent resiliently upwards (see FIG. 5) for easy removal of a blade from stack 60, and for its use as a replacement of old blade 43. Subsequent reassembly of the components takes place as before.

The structures and operations shown and described demonstrate a number of advantages over prior art designs.

Firstly, the use of an integral rearwardly projecting shank 8 gives the immediate advantage, as compared to the use of a through bolt with a manually turnable head, that no space has to be allowed within the housing, whereby space is available in the unencumbered rearward part of the shell for a stack of spare blades.

Also, the joint provision of a spur 9 extending from the upper half of shank 8, and the integral ledge 34 is a considerable advantage in practical use. Hitherto, with a threaded bolt, slackening of the assembly for blade advancement or retraction effectively disconnects the two shells. The knife assembly can come apart, especially if the user is inexperienced or is working with cold hands or in an awkward location. With the present inventive feature, the two part shells are prevented from coming apart completely by the overlap between the spur 9 and the ledge 34 until substantially complete turning of the nut, well beyond that needed for mere advancement or retraction, has taken place. Such a spur can also provide a safety feature for the nut itself. Hitherto, careless unscrewing of the threaded bolt could lead to complete removal and accidental loss. With the present inventive features the nut catches by detent 22 on protrusion 25 in its rearmost position and thus cannot be removed and dropped.

The spur moreover can be fashioned as shown in FIGS. 6 and 7, with a slanting undersurface 61. In such a case the spur 9 is not spaced from ledge 34 but rides up over the edge of this ledge. In other words a rearwardly located second wedging location is provided, so that the part shells do not clamp first at the front and then progressively along their length but clamp in a controlled fashion essentially simultaneously over their whole parting line. This is both better design in that less wear and distortion is likely at the wedging surfaces 6 and 27 and convenient to users in that the different available blade thicknesses can both be used in the knife as shown in FIGS. 6 and 7 by way of example.

Finally, the internal location of shank 8, and the facility thereby given for blade storage can be utilised to give a suitable blade stack retention means of the type shown avoiding rattling of loose blades with unacceptable noise and risk of damage. The nut is retained on spur 9 even at maximum possible unturning, so that opening of the handle for blade changeover can be done easily at any time without loss. Also the elongate nature of polymer leaf 47, as possible in the present design, means that the leaf can be given a rigid structure at the sides 51 of slot 52 where needed as a basis for the stack retaining leaf 59: a bendable portion at the platform 48 to allow upward flexure of the leaf for access to the stack; and a resilient tongue 49/50 to keep the slider and existing blade in place while the stack is being accessed.

I claim:

1. A utility knife with a handle comprising two elongate part shells which assemble about a longitudinal parting line;

forward wedge structure at said parting line and at a forward location of said handle;

means operable to cause one of said part shells to move longitudinally relative to the other part shell whereby component parts of said wedge structure move relatively and cause the said part shells to adopt relative transverse movement to grip or release a blade in a position protruding from a forward end of said handle;

said means operable to cause relative longitudinal movement comprising a threaded shank extending rearwardly from one part shell; a rear wall on the other part shell said rear wall being configured to provide an open slot aperture through which said shank passes and from which it may be removed transversely; and a turnable nut on said threaded shank whereby (a) relative longitudinal movement of the part shells may be achieved by turning the nut on the shank to bear upon the said rear wall, and (b) suitable positioning of the nut allows transverse threaded removal.

2. A utility knife as claimed in claim 1 in which said threaded shank is sufficiently long to extend beyond the nut when the part shells are fully assembled with the nut tightened.

3. A utility knife as claimed in claim 2 further comprising a transverse arrest portion rearwardly located upon the said other part shell to arrest the said threaded shank upon maximum extension with the nut tightened and thereby prevent separation of said part shells bay transverse removal of the threaded shank from the slot aperture until the nut is suitably positioned to allow threaded shank removal.

4. A utility knife as claimed in claim 3 in which said shank terminates in a spur extending rearwardly from part only of the shank cross section; and in that the arrest portion comprises a transverse web located to fit beneath the said spur.

5. A utility knife as claimed in claim 4 in which said other part shell includes a ring guard extending rearwardly around the shank and nut and said web is formed to project forwardly from the inner periphery of said ring guard.

6. A utility knife as claimed in claim 4 in which said spur has an upwardly sloping undersurface positioned to cooperate with an edge of the said transverse web and to constitute a rearwardly located auxiliary clamping configuration for the two part shells with the nut tightened.

7. A utility knife as claimed in claim 1 in which said threaded shank comprises a radial protuberance at an outer end thereof and in which said nut comprises at least one complementary radial detent at an end face thereof to prevent further rotation and separation of the nut beyond the end of said shank.

8. A utility knife as claimed in claim 7 in which said shank comprises two different radial protuberances successively arranged in the direction of rotation to exhibit (a) a lower gently contoured profile over which said detent on said nut may resiliently ride in either direction on exertion of a predetermined and warning amount of force and (b) a higher profile which is step-like to prevent further nut rotation but which is also gently contoured to permit initial assembly of the nut on the shank.

9. A utility knife as claimed in claim 1 in which each part shell is a unitary die cast structure and in which the threads on said shank are interrupted at side portions thereof to permit removal from a mold after the die casting.

* * * * *